US008683766B2

(12) United States Patent
Rutherford

(10) Patent No.: US 8,683,766 B2
(45) Date of Patent: Apr. 1, 2014

(54) CHANNEL SCREED

(76) Inventor: Robert B. Rutherford, Anaheim, CA (US)

( * ) Notice: Subject to any disclaimer, the term of this patent is extended or adjusted under 35 U.S.C. 154(b) by 0 days.

(21) Appl. No.: 13/564,626

(22) Filed: Aug. 1, 2012

(65) Prior Publication Data

US 2014/0033629 A1 Feb. 6, 2014

(51) Int. Cl.
*E04B 2/00* (2006.01)

(52) U.S. Cl.
USPC ..... 52/375; 52/371; 52/364

(58) Field of Classification Search
USPC ..... 52/364, 371, 372, 367, 375
See application file for complete search history.

(56) References Cited

U.S. PATENT DOCUMENTS 2,803,858 A * 8/1957 Rader ..... 52/464
4,825,612 A 5/1989 Tupman
6,018,924 A * 2/2000 Tamlyn ..... 52/716.8
6,354,045 B1 * 3/2002 Boone et al. ..... 52/95
6,609,341 B2 * 8/2003 Maylon et al. ..... 52/367
6,705,052 B1 * 3/2004 Larson ..... 52/95
2008/0307730 A1 12/2008 Rutherford

* cited by examiner

*Primary Examiner* — Mark Wendell
(74) *Attorney, Agent, or Firm* — Trojan Law Offices

(57) ABSTRACT

A channel screed comprises a first member having an internal channel defined by opposed walls extending from a base. The first member includes ribs within the internal channel that accommodate placement of a second member thereon. The first member having surface features that cooperate with surface features of the second member to provide an attachment therebetween. The first member includes fins projecting outwardly from the opposed walls to provide both an indication of building material thickness, and a mechanical attachment therewith. The second member covers the first member internal channel to provide a desired aesthetic appearance to the installed channel screed. The second member comprises a base with opposed walls, and includes flanges projecting from top edges of the opposed wall surfaces. When attached to the first member, the flanges cover up the internal channel, and the interface between the first member and the building material.

18 Claims, 9 Drawing Sheets

CHANNEL SCREED

FIELD OF THE INVENTION

The present invention relates generally to a channel screed, and more particularly, to a multi-piece channel screed specially engineered to include a separate reveal.

BACKGROUND OF THE INVENTION

Channel screeds are generally known in the art and can be used, for example, in the construction of wall surfaces and the like for attaching molding or other trimmings. Such conventional channel screeds can also be used for aesthetic purposes in wall surfaces/structures, such as for providing an aesthetic partitioning in a wall covered with plaster, cement, concrete, mortar, stucco, EIFS (Exterior Insulation and Finishing System), or drywall.

Conventional channel screeds comprise a single member construction having a channel configuration defined by a base and opposed side walls extending a distance in perpendicular fashion from the base. The side walls extend a length from the base that is calculated to provide a desired depth or thickness of the surrounding wall surface material. The channel screed is attached to an underlying wall structure, e.g., a framing member or the like, by fasteners that extend through flanges projecting outwardly away from the base.

Once the channel screed is attached to the wall structure, the wall surface material is applied to the wall structure and is built up in one or more multiples of steps, to a thickness that is approximately that of the side walls. Once the wall surface material is dried, the channel screed operates to provide a desired partition in the wall structure, which can be functional or decorative.

However, several issues are known to exist with such conventional channel screeds when used in this manner. The process of building up a wall surface using concrete or other wall surface material is a messy process requiring that one or more steps be implemented during the process to keep the exposed surface of the channel screed clean or protected, e.g., by masking or other similar task. Typically, such precautions are not taken or not implemented correctly because of the extra effort and time involved in doing so at the job site. As a result, the exposed surface of the channel screed very often becomes stained and/or scratched or otherwise damaged during the process of building the wall surface, impairing or ruining its desired use as an aesthetic element in the wall structure.

Another issue known to exist with the use of such conventional channel screeds is the formation of cracks that develop in the wall surface adjacent the channel screed. The cracks result during the process of the wall surface drying and contracting adjacent to the relatively immobile channel screed. The presence of the cracks in the wall surface both detracts from the intended purpose of the channel screed, to aesthetically enhance the wall surface, and operates to provide unwanted water intrusion paths into the wall system and underlying wall structure.

A further issue known to exist with the use of such conventional channels creeds relates to the manner in which the channel screed is attached to the underlying wall structure. Typically, two or more fasteners are used to attach the channel screed to the wall structure and extend through one or more flanges projecting from the base and into the wall structure. The presence of such fasteners operates to provide a path for water to enter or intrude into the wall structure. Such water intrusion is unwanted as it can cause damage to the underlying wall system. Further, the presence of such flanges operates to cause cracks to develop within the wall structure, and also operates as a leak path for unwanted water intrusion into the wall structure.

It is therefore desired that a channel screed be constructed to facilitate its use as an element in a wall surface in a manner that preserves its external finish to provide a desired aesthetic effect, and do so in a manner that is not time or labor intensive in the field. It is desired that the channel screed be constructed in a manner that minimizes the formation of cracks in the wall surface and/or that covers the presence of such cracks from observation when viewing the wall surface. It is further desired that the channel screed to be constructed in a manner that reduces the possible water intrusion paths into the wall structure or system, thereby operating to minimize unwanted water damage.

SUMMARY OF THE INVENTION

A channel screed for use with a surface of a structure comprises a multi-piece construction. In a preferred embodiment, the channel screed comprises a first member having an internal channel defined by opposed walls extending upwardly form a base. The first member is attached to an underlying structural member before installation of a building material to form the desired surface structure. The first member includes ribs extending inwardly within the internal channel that are positioned a distance from the base. The ribs are configured to accommodate placement of a second member thereon.

The first member includes surface features positioned within the internal channel designed to cooperate with complementary surface features of second member to provide a locking attachment therebetween. The first member optionally includes fins projecting outwardly from the outside surfaces of the opposed walls. The fins are configured to both provide an indication of building material thickness, and a mechanical attachment therewith.

The second member is configured to least partially cover the first member internal channel to thereby provide a desired aesthetic appearance to the installed channel screed. The second member comprises a base with opposed walls extending upwardly from the base. The second member includes flanges that project outwardly a distance from top edges of the opposed wall surfaces. When attached to the first member, the flanges operate to cover up the first member internal channel, and cover over the interface between the first member and the building material. The second member can also be a removable covering that covers the internal channel of the first member, the base of the second member resting substantially flush with the top edges of the first member, thereby closing off the internal channel from the top, preventing building material from entering the internal channel.

Configured in this manner, the channel screed functions to provide an installed product that is always aesthetically pleasing, to minimize formation of unwanted cracks in the building material, and reduce unwanted entry points of moisture into the underlying structure.

Additional moisture protection features may include having a flexible water resistive barrier, such as rubber, on the base of the first channel member, or various features of the first or second channel member, which create a water-tight seal between the first and second channel members.

BRIEF DESCRIPTION OF THE DRAWINGS

These and other features and advantages of the present invention will become appreciated as the same becomes better understood with reference to the specification, claims and drawings wherein:

DETAILED DESCRIPTION OF THE DRAWINGS

Figure 1:
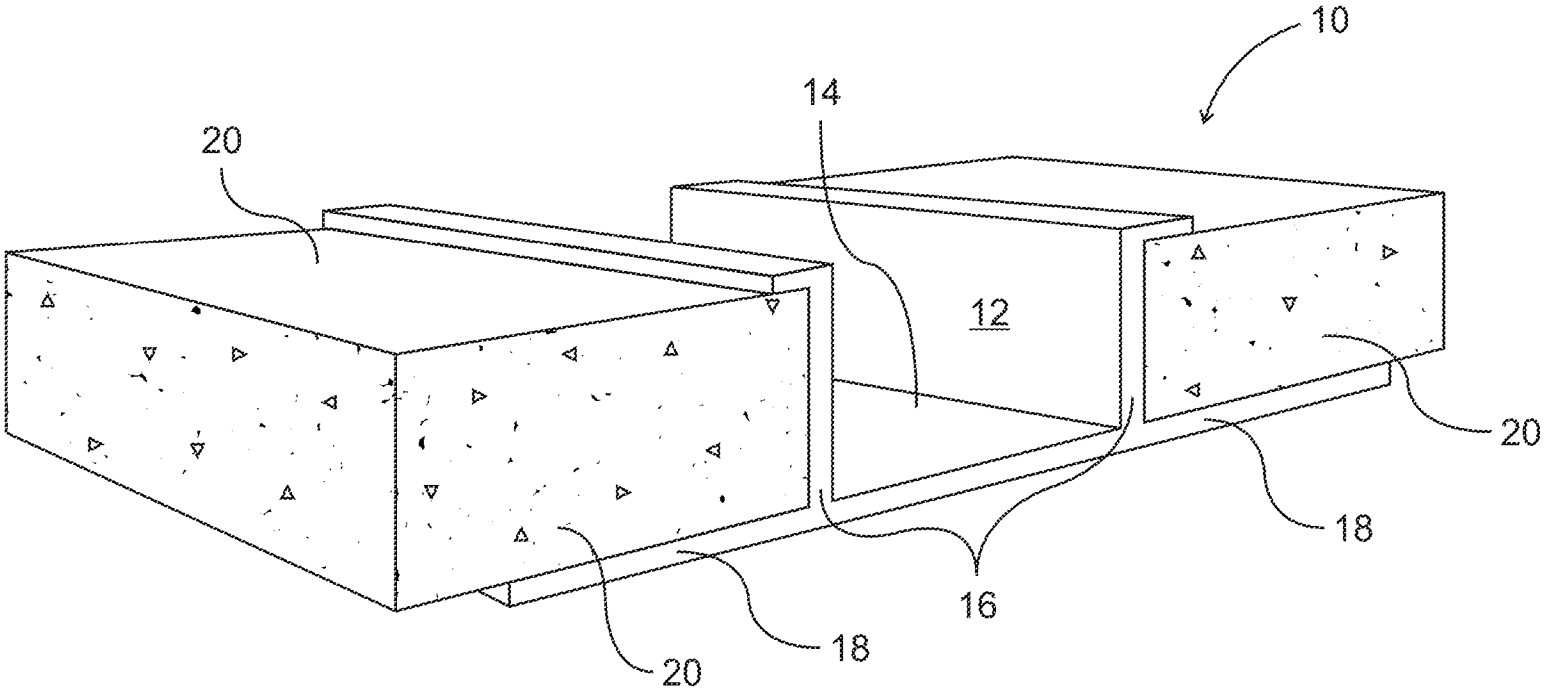
FIG. 1 is a perspective view of a conventional channel screed.

FIG. 1 illustrates a conventional or prior art channel screed 10 comprising an internal channel 12 that is defined by a base 14, extending along the bottom of the channel, and a pair of opposed side walls 16, extending in perpendicular fashion upwardly from the base 14. The channel screed 10 includes flanges 18 extending outwardly away from opposed sides of the base 14. As noted briefly above, the side walls 16 provide a guide for an even application of a wall surface material 20, such as plaster, stucco, cement or other exterior building material, and allows for the expansion or contraction of adjoining panels of the exterior material. The flanges 18 allow the channel screed 10 to be secured to an underlying wall structure, e.g., framing members/studs or the like.

Figure 2:
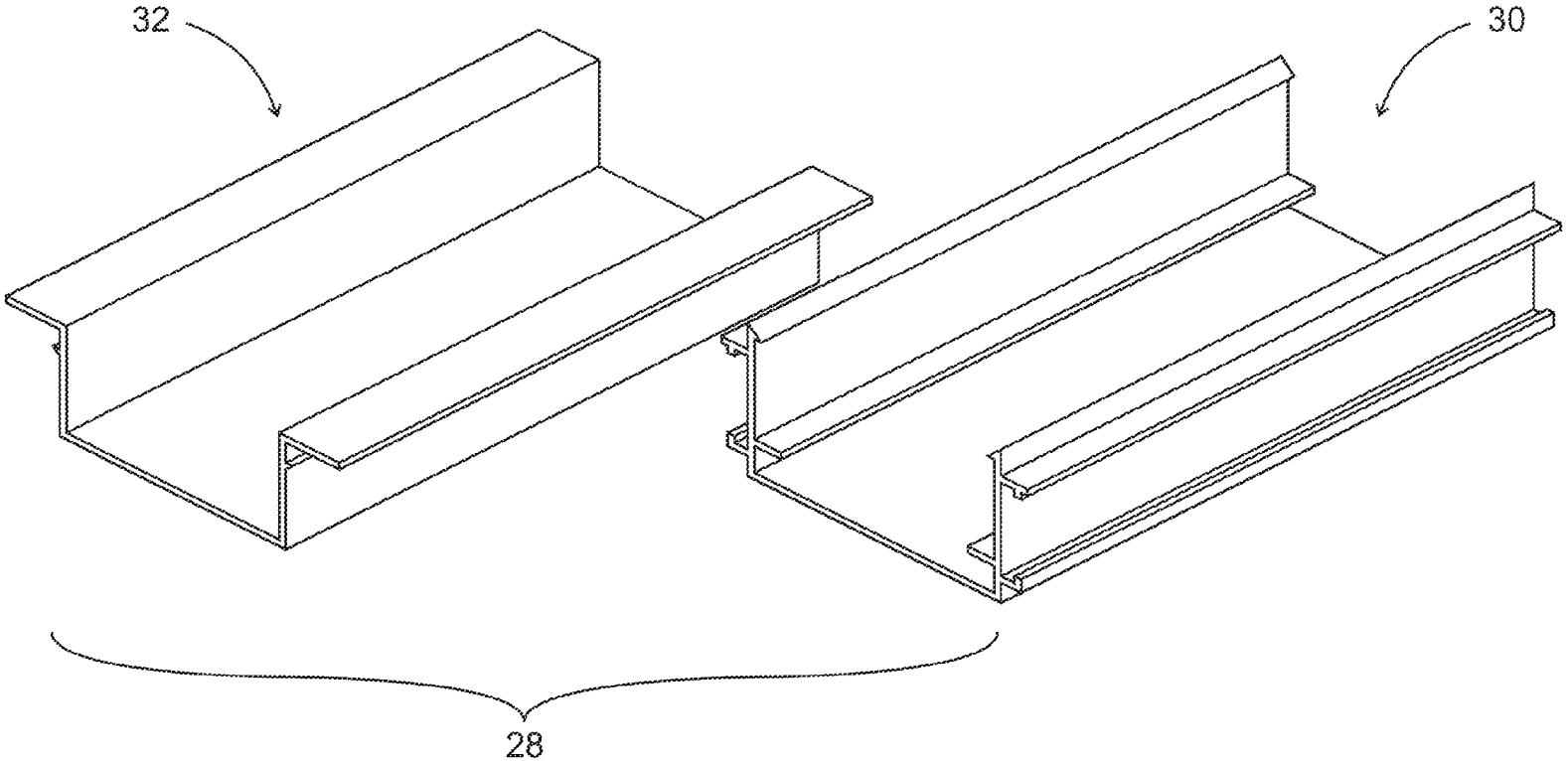
FIG. 2 is an exploded view of a channel screed prepared according to principles of the invention comprising a channel member and a reveal member.
Figure 3A:
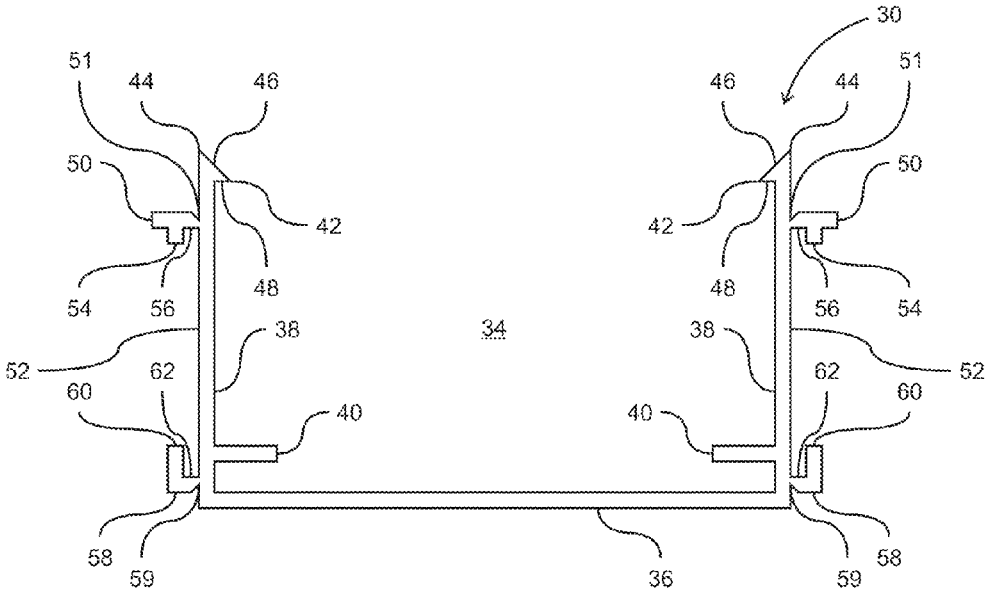
FIG. 3*a* is a cross-sectional end view of the channel member of FIG. 2.

FIG. 2 is an exploded view of an example embodiment channel screed 28 constructed according to principles of the invention comprising a multi-piece construction. In a preferred embodiment, the channel screed 28 is provided as a two-piece construction comprising of a channel member 30 and a reveal member 32. With additional reference to FIGS. 3*a* and 3*b*, the channel member 30 is formed from a suitable rigid structural material, such as plastic, metal and the like, and in a preferred embodiment is formed from aluminum. The channel member 30 is an elongate structure having an internal channel 34 that is defined along a bottom surface by a base 36, and along opposed side surfaces by side walls 38 extending upwardly in perpendicular fashion from the base 36. It is understood that the size of the channel member 30 (i.e., its length and the dimensions of the base 36 and side walls 38) can and will vary depending on the particular end-use application. In an example embodiment, the side walls 38 are sized having a height useful for accommodating a desired thickness of the wall surface material, e.g., having a top edge 44 positioned to facilitate the depth or thickness of a plaster or stucco finish coat.

The channel member 30 includes a pair of ribs 40 that are positioned opposite one another, that are disposed within the internal channel 34, and that project inwardly a distance towards one another from the opposed side walls 38. The ribs 40 extend a distance into the internal channel 34 sufficient to accommodate placement of a bottom surface of the reveal member 32 thereon when the reveal member 32 is disposed within the channel member internal channel 34 (as described in greater detail below). In an example embodiment, the ribs 40 are positioned a distance above the base 36 sufficient to clear one or more fasteners 82 disposed through the base (shown in FIG. 5), used to attach the channel member 30 to an underlying wall structure 43, such that when the reveal member 32 is disposed within the internal channel 34 it does not contact the one or more fasteners 82. In an example embodiment, the ribs 40 are generally rectangular shaped elements that extend along the length of the internal channel 34.

Figure 3B:
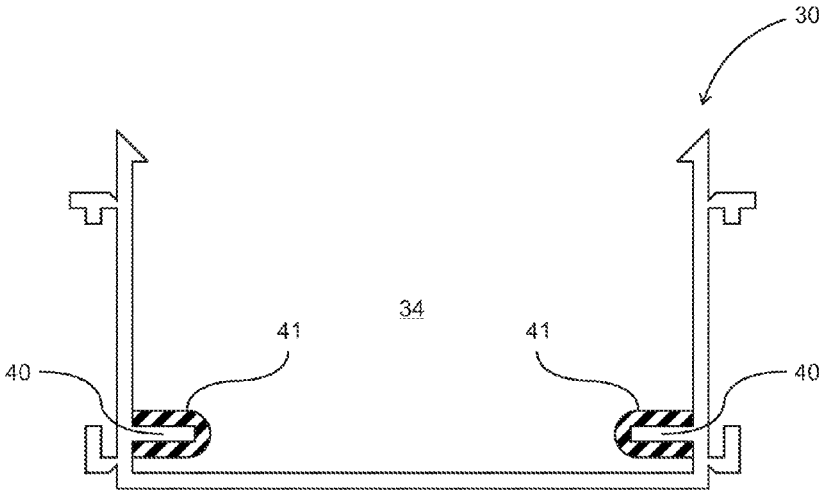
FIG. 3*b* is a cross sectional end view of the channel member of FIG. 2 with U-shaped rubber coating on the ribs.

If desired, the ribs 40 can be configured having a resilient cover disposed thereover, e.g., can be configured having a U-shaped silicon or rubber cover 41 positioned over the ribs 40, to provide a water-tight seal between the reveal member 32 and the channel member 30 once the reveal member 32 is disposed within the channel member internal channel 34 (See FIG. 3*b*). Alternatively, instead of using a preformed resilient member to cover the ribs, a suitable liquid sealing material can be applied to the ribs prior to installation of the reveal member to provide the desired water-tight seal. Alternatively, the ribs 40 can have a layer of rubber or other flexible elastic barrier 162 placed on one or more sides of the ribs 40 or a flexible elastic layer 168 on the base of the channel member 30 (see FIGS. 11, 12). The existence of such a water-tight seal may be desired in certain end-use applications as a means for reducing or eliminating the possibility of water intrusion into the channel member 30.

Figure 5:
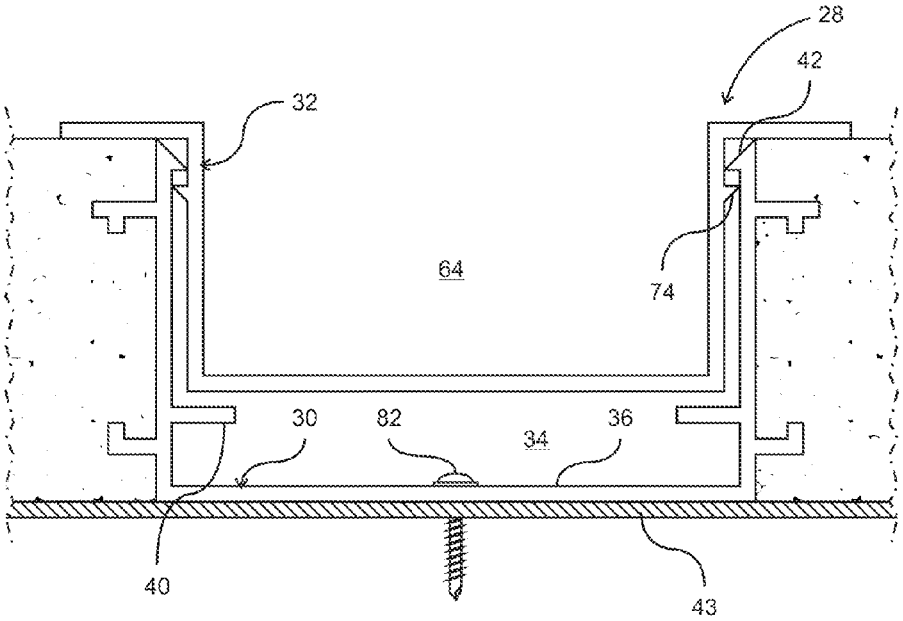
FIG. 5 is a cross-sectional end view of the channel screed as disposed in a wall surface and comprising the reveal member disposed within the channel member.
Figure 6:
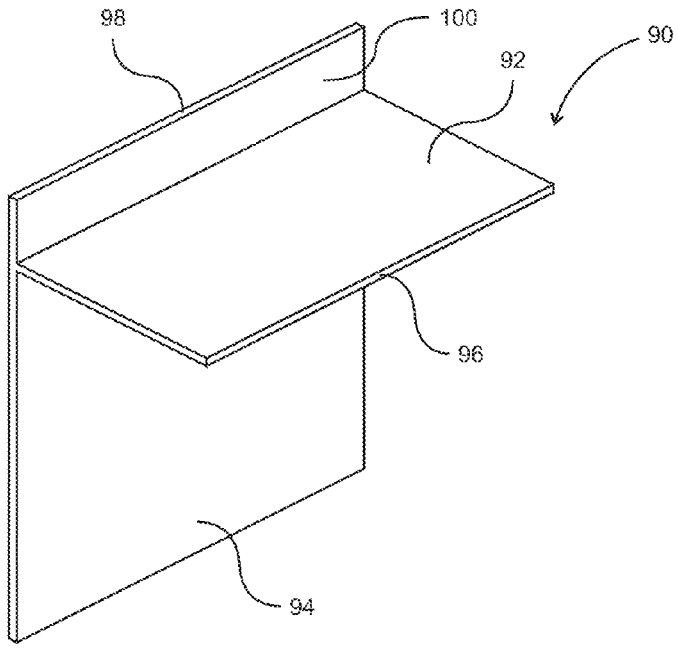
FIG. 6 is a perspective view of end cap for smooth transition of the reveal and channel members of FIG. 2 with a J-stop.
Figure 7:
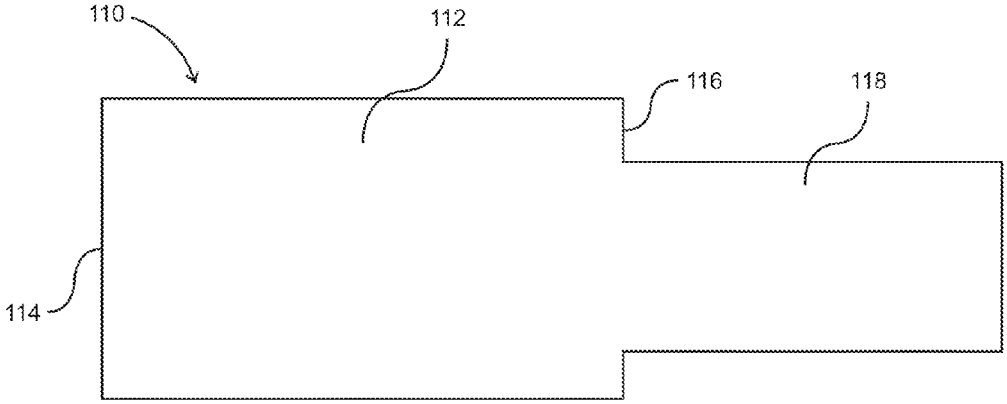
FIG. 7 is a side view of a side dam for smooth transition of the reveal and channel members of FIG. 2 with a J-stop.

The channel member 30 also includes a pair of ridges 42 that are positioned opposite one another disposed within the internal channel 34, and that project inwardly a distance towards one another from the opposed side walls 38. The ridges 42 are positioned adjacent a top edge 44 of the side walls 38 and are configured having an arrow-shaped profile with a downwardly angled surface 46, moving inwardly into the interior channel 34 and a generally flat underside surface or section 48 extending from the angled surface to the side wall 38. Configured in this manner, the ridges 42 operate to provide a locking engagement with the reveal member 32 when disposed within the internal channel 34 (as better described below). In an example embodiment, the ridges 42 project inwardly into the internal channel 34 a sufficient distance to both permit passage of the reveal member 32 therein, and engage a cooperating surface element of the reveal member (as best shown in FIG. 5 as 32) to prevent outward removal of the reveal member 32 once engaged. The ridges 42 can be positioned anywhere along the side wall surfaces 38 above the ribs 40. In an example embodiment, the ridges 42 are positioned adjacent the top edge 44 of the side walls 38 and extend along the length of the internal channel 34.

The channel member 30 optionally includes a pair of fins 50 that extend outwardly a distance from an outside surface 52 of the side walls 38. The fins 50 are positioned near the side wall top edge 44 at a location useful for defining the thickness of the wall surface material (i.e., for the thickness or depth of a plaster brown coat, when the channel member 30 is attached to an underlying wall structure). The fins 50 extend outwardly a distance sufficient for this purpose. In an example embodiment, the fins 50 may be configured having a relief 51, or section of reduced thickness such as a microgroove, adjacent the side wall 52 outside surface to permit the fins 50 to be sacrificially broken away from the channel member 30 in the event it is desired to remove the channel member 30 from the surrounding wall surface 52 once installed. In an example embodiment, the fins 50 extend along the length of the channel member 30.

If desired, the fins 50 may include a downwardly directed lip 54 configured to provide a slot 56 between the lip and the side wall outside surface 52. The slot 56 is useful for providing a mechanical locking attachment of the surrounding wall surface material therein to enhance the interconnection of the channel member therewith, and thereby help to minimize or prevent unwanted detachment and/or crack formation between the wall surface material and the channel screed 28. Additionally, as better described below, the slot 56 can be used for accommodating placement of one or more further molding elements therein as called for by the particular channel screed 28 end-use application. One such application is the use of having an end cap 90 and two side dams 110 (See FIGS. 6-9) to cap the end of the channel member 30 and prevent building material from entry into the channel screed channel screed 28, and may be assembled with a J-stop.

The channel member 30 can optionally include a second pair of fins 58 that extend outwardly a distance from the outside surface 52 of the side walls 38. The second pair of fins 58 is positioned near a bottom edge of the side wall 58 adjacent the base 36. In an example embodiment, the second pair of fins 58 has an L-shaped configuration comprising an upwardly facing lip 60 configured to provide a slot 62 between the lip and the side wall outside surface 52. The slot 62 is useful for providing a mechanical locking attachment of the surrounding wall surface material therein to enhance the interconnection of the channel member therewith, and thereby help to minimize or prevent unwanted detachment and/or crack formation between the wall surface material and the channel screed 28. Additionally, as better described below, the slot 62 can be used in conjunction with slot 56 for accommodating placement of one or more further molding elements therein as called for by the particular channel screed 28 end-use application (See FIGS. 8 and 9 for a J-stop end use embodiment).

Like the fins 50 described above, the second pair of fins 58 may be configured having a relief 59, or section of reduced thickness such as a microgroove, adjacent the side wall outside surface 52 to permit the fins 58 to be sacrificially broken away from the channel member 30 in the event it is desired to remove the channel member 30 from the surrounding wall surface 52 once installed. In an example embodiment, the second pair of fins 58 extends along the length of the channel member 30.

Figure 4:
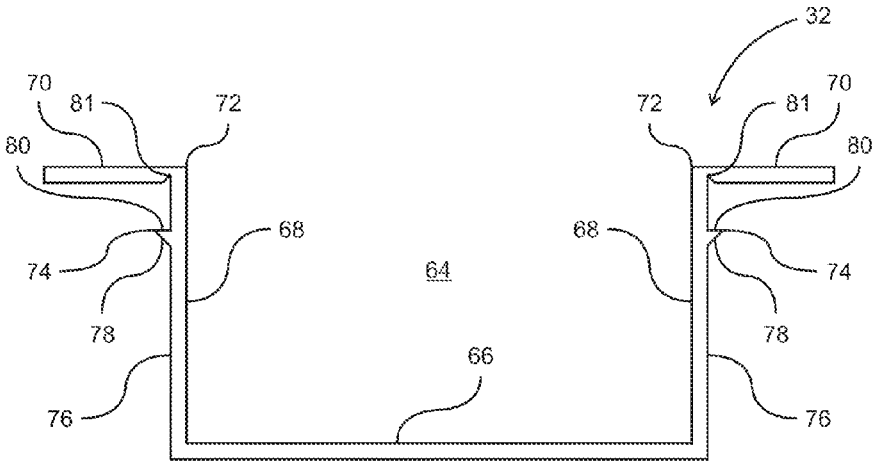
FIG. 4 is a cross-sectional end view of the reveal member of FIG. 2.

As best illustrated in FIG. 4, the reveal member 32 is formed from a suitable rigid structural material, such as plastic, metal and the like, and in a preferred embodiment is formed from aluminum. The reveal member 32 is an elongate structure having an internal channel 64 that is defined along a bottom surface by a base 66, and along opposed side surfaces by side walls 68 extending upwardly in perpendicular fashion from the base 66. The reveal member 32 is sized to fit within the channel member 30 internal channel 34. Thus, the reveal base 66 is sized having a width (as measured between the opposed side walls 68) that is less than that of the channel member base 36.

The reveal member 32 includes a pair of flanges 70 that extends outwardly in perpendicular fashion from top edges 72 of the side walls 68, and that extend along the length of the reveal member. In an example embodiment, the flanges are sized to extend a sufficient distance away from the respective side walls 68 so as to extend beyond the channel member side wall top edges 44 and over a portion of the adjacent wall surface 52 when installed within the channel member 34. Configured in this manner, when installed within the channel member 34, the reveal member flanges 70 operate to both protect against unwanted water intrusion into the channel member internal channel 64, and cover up any cracks that may exist in the wall surface adjacent the channel member 30. Like the fins 50, 58 described above, the pair of flanges 70 may be configured having a relief 81, or section of reduced thickness such as a microgroove, adjacent the side walls outside surface 76 to permit the flanges 70 to be sacrificially broken away from the reveal member 32.

The reveal member 32 also includes a pair of ridges 74 that is positioned along an outer surface 76 of the side walls 68, that project outwardly a distance away from each respective side wall 68, and that extend along the length of the reveal member 32. The ridges 74 are positioned adjacent the top edge 72 of the side walls and are configured having an angled surface 78, along a bottom portion that flares outwardly moving towards the top edge, and a flat top surface or section 80 moving inwardly towards the outer surface 76.

As best illustrated in FIG. 5, the reveal member ridges 74 are configured and positioned to cooperate with the channel member ridges 42, disposed within the internal channel 34, upon placement of the reveal member 32 within the channel member internal channel 34. Specifically, the angled surfaces 78, 46 of the respective reveal member and channel member ridges 74, 42 are shaped to complement one another, e.g., having complementary angles of departure from the respective side wall surfaces, to facilitate inward sliding downward movement of the reveal member 32 within the channel member internal channel 34. Once the angled surfaces of the respective ridges 74, 42 pass along one another, the flat sections 80, 48 of the respective ridges 74, 42 engage one another to provide a locked engagement/attachment of the reveal member 32 within the channel member internal channel 34. In an example embodiment, this locked engagement is not releasable.

In an example embodiment, the ridges 74 are positioned to permit some sliding movement of the reveal member 32 relative to the channel member 30 when attached thereto to enable for possible sliding adjustments in the field depending on the particular end-use application. Configured in this manner, the ridges 42 and 74 operate to provide a snap attachment of the reveal member 32 within the channel member 30 once the channel member 30 is disposed within the finished wall structure.

Channel members can be attached to other channel members, or to other molding elements, through the use of the slots 56 and 62 present along the outer surfaces of the side walls 52. For example, rectangular interconnection tabs can be interposed between adjacent channel members and installed within the slots 56 and 62 of such channel members to align and connect the channel members together. These tabs can be used to align the channel members for welding or otherwise attaching the channel members together.

An end cap connector 90 (illustrated in FIG. 6) can be used to terminate the channel member 30 within a wall system by using a J-stop 122 (illustrated in FIG. 9), thereby closing off the internal channel 34 thereby preventing wall surface material from entering the internal channel 34. In an example embodiment, the end cap connector 90 includes a rear tongue 94 that extends into the internal channel 34 of the channel member 30 and is trapped between the channel member base 36 and ribs 40. The end cap 90 includes a front section 92 that projects upwardly in perpendicular fashion from the rear tongue 94 to cover and close off the open end of the channel member internal channel 34. The end cap front section 92 has a height substantially equal to that of the channel member side walls 38. The end cap 90 has a front tongue section 100 perpendicular to the front section 92 to help align the end cap 90 with the J-stop 122.

To further close off openings in the channel screed 28, side dams 110 (See FIGS. 7-9) can optionally be installed within the slots 56, 62 of the channel member 30. The side dams 110 comprise a front tab 112 with a front edge 114, and rear tab 118 having a shorter height than the front tab 112 (See FIG. 7). A middle edge 116 at the juncture between the front tab 112 and rear tab 118 prevents the side dams 110 from inserting too deeply into the channel member 30. The height of the front tab 112 is substantially the same as the height of the front section 92 of the end cap 90, thereby covering any space between the non-overlapping regions of the channel member 30 and reveal member 32. The front edge 114 of the side dams 110 sit flush with the side panel 128 of the J-stop 122, effectively covering any gap remaining between the side panel 128 and the front section of the end cap 92.

Figure 8:
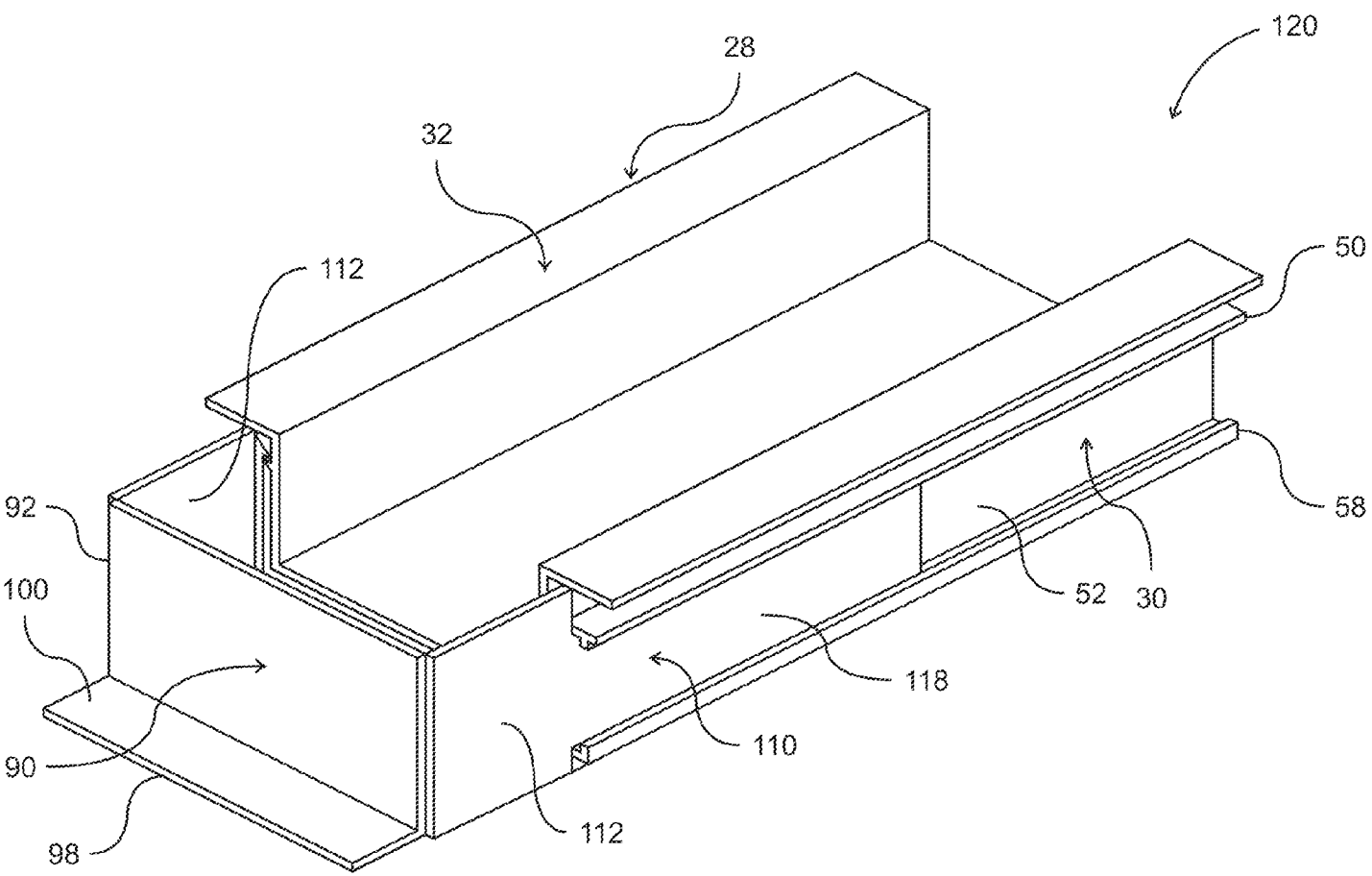
FIG. 8 is a perspective view of an assembled channel and reveal member with an end cap and side dams.
Figure 9:
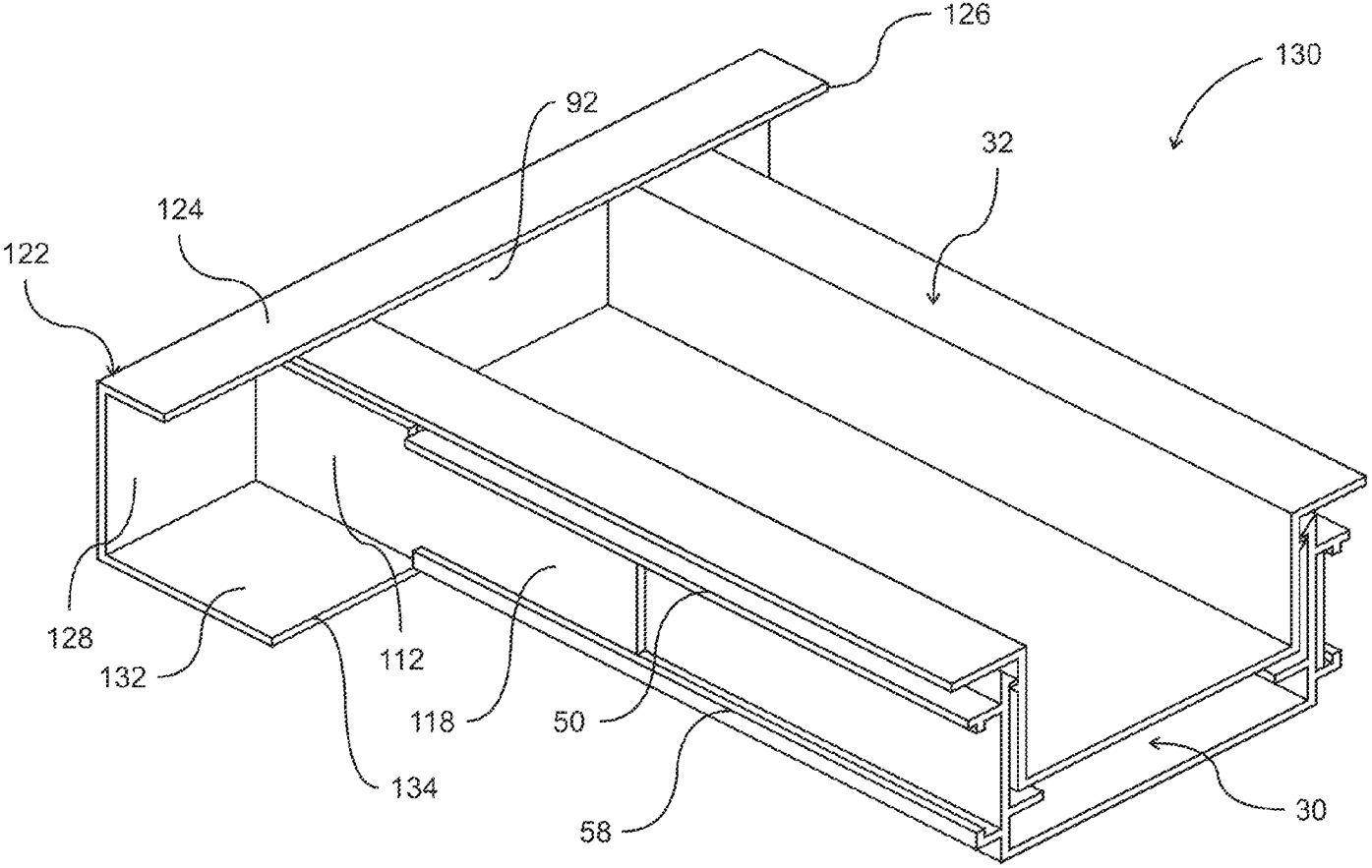
FIG. 9 is a perspective view of an assembled channel and reveal member with end cap and side dams disposed within a J-stop.

FIG. 8 illustrates an example embodiment of an assembled channel screed with an end cap and side dams 120, and FIG. 9 illustrates the same embodiment assembled with a J-stop 130. The J-stop 122 not only is an esthetically pleasing termination end of a channel screed 28, but also functions to prevent building material from entering the channel screed 28 by blocking openings into the internal channels 34, 64 (See FIGS. 3 and 4).

The J-stop 122 has a bottom panel 132, a side panel 128 perpendicular to the bottom panel 132, and a top panel 124 perpendicular to the side panel 128 and parallel with the bottom panel 132. To align the channel screed 28 to the J-stop 128 the internal channel 34 of the channel member 30 is open in the direction of the top panel 126 and the front section 92 is perpendicular and flush to the front edge 126 of the J-stop 122. The front tongue section 100 has a length that is substantially the same as the length of the top panel 126 of the J-stop 122, such that when the channel screed 28 is inserted within the J-stop 122, front tongue edge 98 rests flush with the side panel 128. The channel member 30 is prevented from overlapping the bottom panel 132 by sitting flush with the front edge of the bottom panel 134. The internal channel 32 slides forward, overlapping the bottom panel 132 until it contacts the front edge of the top panel 126.

Figure 10:
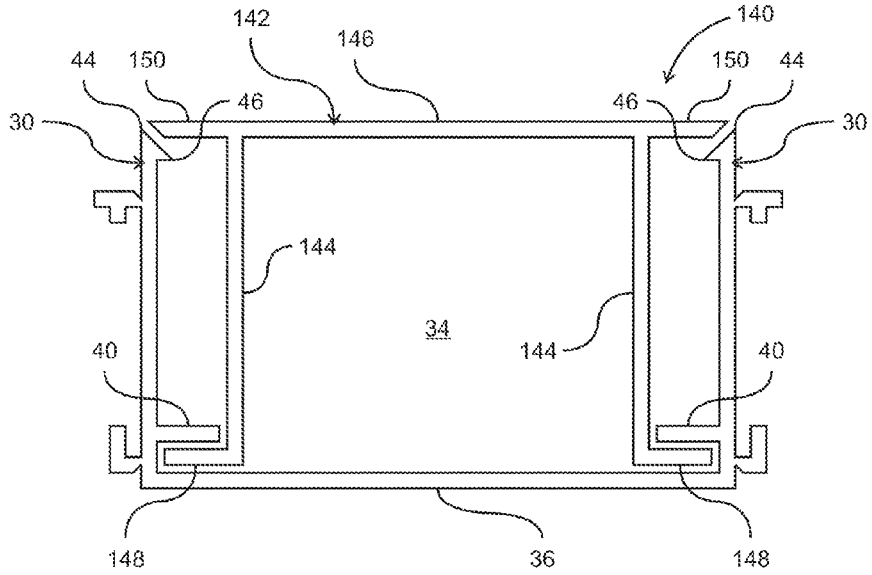
FIG. 10 is a side view of a channel member with an internal channel cover.

In an example embodiment that protects against building material intrusion into the channel member 30, FIG. 10 depicts an embodiment of channel cover installed over an internal channel 140. The channel cover 142 can be provided in the form of an easily insertable and easily removable element. The channel cover 142 includes one or more surface features to facilitate removable engagement with the internal channel 34. In an example embodiment, the channel cover 142 is provided in the shape of a U-shaped element, having a base 146 and opposed side walls 144 extending therefrom, having base end flanges 150 that engage with, and adjacent to, the side wall top edges 44.

The channel cover 142 is sized to fit within the channel member internal channel 34 and protect the internal channel 34 from the wall surface material during build up. Opposing rib flanges 148 are configured and sized for placement in the slots defined between the base 36 and the ribs 40. Ideally, the channel cover 142 is made from a resilient material, such as plastic or the like, that is capable of being elastically deformed, e.g., by pressing the opposed side walls 144 together, to both install and move the channel cover 142 from the channel member internal channel 34 easily by hand in the field. In an example embodiment, the channel cover 142 can be reused over and over again. Configured in this manner, the channel cover 142 can be easily installed in the field upon attachment of the channel member 30, and removed after application of the wall surface material prior to installment of the reveal member 32. The use of such a channel cover 142 eliminates the time consuming process of covering the channel member by tape or the like.

Once the channel member 30 is installed, and the channel cover 142 is installed within the internal channel 34, the wall surface material then is applied. In an example embodiment, when the wall surface material is plaster or stucco, it is typically applied in three different steps. First, a scratch coat is applied, then a brown coat is applied over the scratch coat, and thirdly a color or finish coat is applied over the brown coat. The channel screed of this invention comprises fins 50 positioned to provide an indication of a desired depth of the brown coat. In an example embodiment, the fins 50 are positioned to provide a ¾ inch deep brown coat and are disposed approximately ⅛ inches from the side wall top edges 44. The presence of the fins 50 operate to promote obtaining a true consistent ¾ inch thick brown coat along the wall surface. This is advantageous because when the brown coat is consistent so too will be the finish coat, giving rise to a substantially flat wall structure. The edges of the channel member side walls 38 further operate as a guide to the depth of the finish coat. Thus, the channel screed 28 operates to facilitate building a substantially flat wall surface.

Once the wall structure material is applied, and the channel cover 142 is removed from the channel member 30, the reveal member 32 is installed into the channel member internal channel 34 and snapped into locking engagement therewith.

Figure 11:
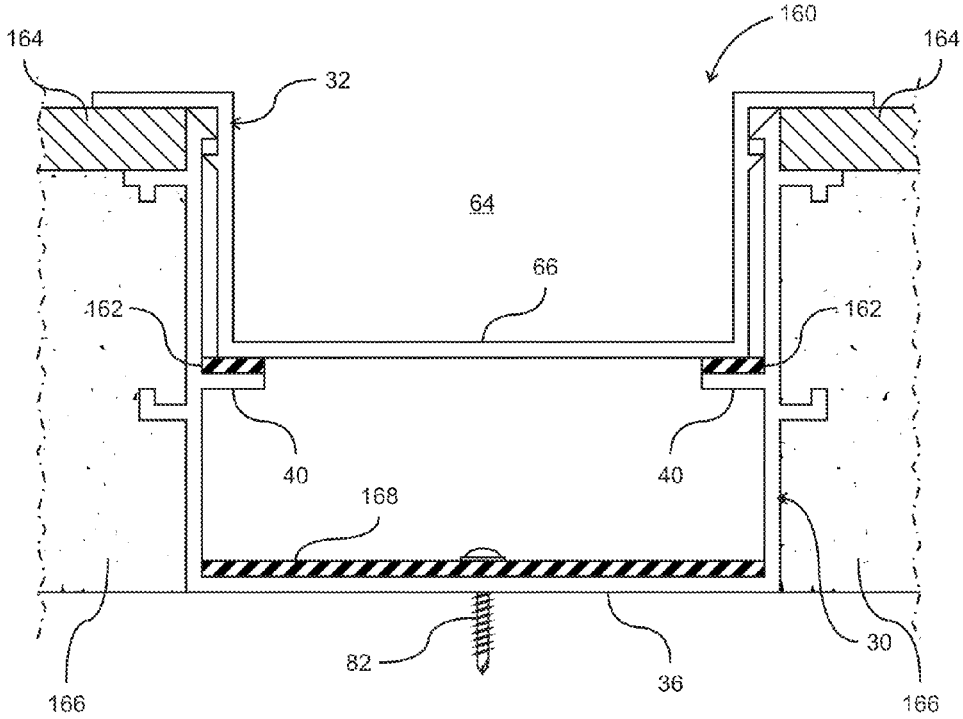
FIG. 11 is a cross sectional view of a channel screed with water resistance features assembled with an insulation layer; and, FIG. 12 is a cross section view of a channel screed with water resistance features assembled with an insulation layer.
Figure 12:
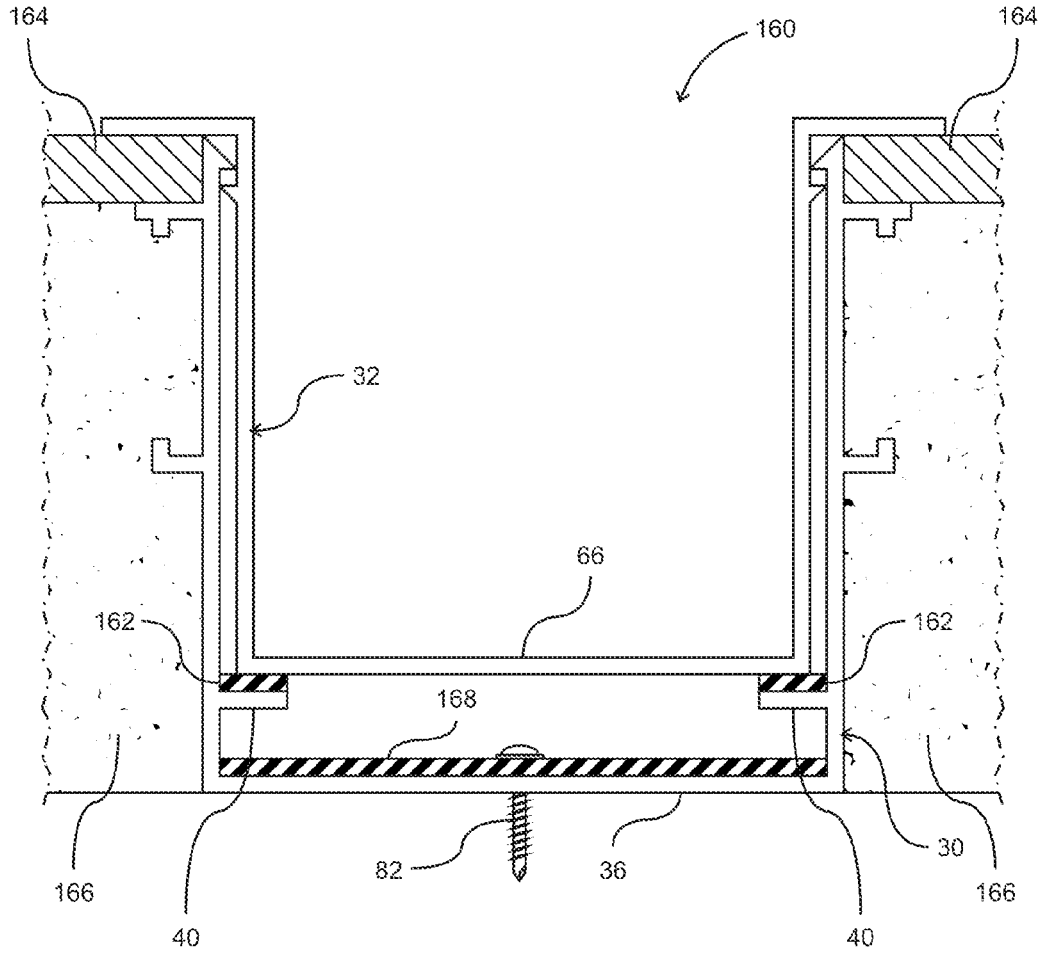

In another embodiment, illustrated in FIGS. 11 and 12, the channel screed 28, is assembled with an insulation layer having water resistance features 160. The base of the channel member 36 may be moved back from the ribs 40 to provide for a substantially deep channel member 30 compared to the depth of the reveal member 32. Optionally, as in FIG. 12, the base of the reveal member 66, along with the base of the channel member 36 may be moved back. This added depth to the channel member accommodates a thick insulation layer 166 and a finishing layer 164. Additional water resistance features include a flexible elastic layer 168 (such as rubber) secured to the base of the channel member 36. This flexible elastic layer 36 provides for improved water resistance by sealing holes created when a fastening device such as a screw 82 penetrates the wall. Normally, the penetrating screw 82 forms a hole that creates a leak path that water could seep into, however, by providing the flexible elastic barrier 168 to the base 36, the flexible elastic barrier 168 presses and fills in small spaces formed by the penetrating screw 82, thereby improving water resistance. An additional water resistance feature is the water resistive barrier 162 located on the ribs 40 of the internal channel 30. Any water that may seep through the reveal channel 32 would be unable to pass through the internal channel 64 due to the flexible water resistive barrier 162 blocking the moisture, thereby improving water resistance.

A feature of the channel screed of this invention is that is does not include installation flanges 18 as does the prior art (as illustrated in FIG. 1). Rather, the channel screed 28 is installed by fasteners extending through the base 36 of the channel member, eliminating approximately 50 percent of the fasteners since twice as many fasteners are needed (one per flange) instead of a single fastener through the base of the channel member 36. Eliminating 50 percent of the fasteners operates to remove 50 percent of possible water leak paths into the wall system, thereby providing a 50 percent reduction of unwanted water intrusion. Further, providing a structure that is free of the installation flanges also reduces a cause of crack formation in the wall surface material, thereby further operating to both reduce the unwanted presence of cracks and minimize unwanted water intrusion that can occur from the presence of such cracks.

The channel screed 28 is installed in a wall system by first attaching the channel member 30 to an underlying wall structure by use of one or more fasteners (illustrated in FIG. 5 as 82). The fasteners 82 extend through the channel member base 36 to the underlying wall structure. The channel member can be sized having an uninterrupted length, or a number of the channel members can be connected together as called for by the particular end use application. In the event that two or more channel members are used, they can be connected together by welding, soldering, or other suitable operation. A feature of the invention is that since the reveal member is placed over the top of the channel member, the presence of such welds is not seen and does not detract from the eventual aesthetic presentations of the end product.

A feature of the channel screed 28 of this invention is the use of a multi-piece construction comprising a reveal member 32 that is separate from the channel member. This permits the channel member 30 to be installed, and the wall surface material to be applied, without worry about the appearance of the end product. Once the wall surface material is applied, the reveal member 32 is installed to provide the desired clean aesthetic. Further, as noted above, the reveal member 32 can be installed within the channel member 30 to provide a water-tight seal therebetween, thereby further operating to reduce or eliminate unwanted water intrusion within the wall structure.

A further feature of the channel screed 28 of this invention is the presence of fins 56, 60 that both operate to facilitate attachment of the channel screed with one another and/or with additional wall structure elements, and that operate to enhance the degree of attachment with the surrounding wall structure, thereby operating to minimize/prevent crack formation which reduces or eliminates unwanted water intrusion within the wall structure.

While the invention has been described in terms of exemplary embodiments, it is to be understood that the words which have been used are words of description and not of limitation. As is understood by persons of ordinary skill in the art, a variety of modifications can be made without departing from the scope of the invention defined by the following claims, which should be given their fullest, fair scope.

I claim:

1. A channel screed for use within a surface of a structure, the channel screed comprising:

a first member comprising an internal channel defined by opposed walls extending from a base, a bottom slot, and a pair of opposing side slots, wherein the base is attachable to an underlying element of the structure, and wherein a building material, used to form the surface of the structure, extends along outside surfaces of the opposed walls;

a second member that is connected with the first member to at least partially cover the internal channel; and, a three part connector comprising an end cap, and two side dams, the end cap capable of being inserted within said bottom slot, and said two side dams capable of being inserted within said pair of opposing side slots, thereby preventing building material from entering the internal channel.

2. The channel screed of claim 1 wherein the first member walls include a surface feature that cooperates with the second member to provide a locking connection therebetween.

3. The channel screed of claim 2 wherein the second member includes opposed walls and the opposed walls have a surface feature projecting therefrom that cooperates with the surface feature of the first member.

4. The channel screed of claim 1 wherein the second member includes opposed walls and a base substantially perpendicular to the opposed walls, and wherein the base of the second member is substantially the same width as the base of the first member, whereby insertion of the second member within the first member encloses the internal channel of the first member between the base of the first member and the base of the second member.

5. The channel screed of claim 1 wherein the second member comprises an internal channel that fits inside of the internal channel of the first member.

6. The channel screed of claim 5 wherein the second member comprises opposed walls that fit within the opposed walls of the first member, and wherein the second member includes a flange extending outwardly from a top edge of each wall, the flanges extending over respective top edge surfaces of the first member walls.

7. The channel screed of claim 6 wherein the flanges are capable of breaking at a predetermined distance from the first member at a breakpoint, wherein the breakpoint is a micro-groove at the juncture between the flanges and the side walls of the second member.

8. The channel screed as recited in claim 1 wherein the second member is locked together with the first member.

9. The channel screed of claim 8 wherein the first member walls include two surface features in the form of ridges and ribs extending longitudinally along the wall surface projecting into the internal channel, wherein the ridges are positioned adjacent a top edge surface of the walls, and wherein the ribs are positioned parallel to the base.

10. The channel screed of claim 9 wherein the ribs further comprise a water resistive layer, thereby providing a water-tight seal between the first member and the second member.

11. The channel screed of claim 9, further comprising a water resistive layer adjacent the base of the first member thereby providing a water-tight seal preventing moisture from traversing the base if holes exist in the base.

12. A wall system comprising a channel screed disposed within a wall surface, wherein the channel screed comprises:

an elongate channel member having an internal channel defined by a base and opposed walls, wherein the base is attached to an underlying wall structure, and wherein a building material, used to form the wall surface, is in contact with outside surfaces of the opposed walls; and an elongate reveal member attached to the first elongate member, wherein the reveal member is disposed within the first member internal channel, and is attached to the first member by surface features in both the channel member and reveal member that cooperate with one another;

a three part connector disposed within the elongate channel, wherein the three part connector comprises an end cap, and two side dams, thereby preventing building material from entering the elongate channel.

13. The wall system of claim 12 wherein the channel member includes one or more surface features extending therefrom that project into the building material used to form the wall surface.

14. The wall system of claim 12 wherein the reveal member is attached to the channel member by a snap connection provided by cooperation of the reveal member and channel member surface features.

15. The wall system of claim 12 wherein the elongate channel member and the elongate reveal member are disposed within a J-stop.

16. A method for using a channel screed within a wall surface comprising the steps of:

installing a first screed member onto a structural surface, the first screed member comprising a base and opposed side walls extending upwardly from the base, the walls and base together defining a first member internal channel;

applying a building material for forming the wall surface, wherein the building material is disposed around the first screed member and is in contact with an outside surface of the first member walls;

installing a second screed member onto the first member, wherein the second member covers at least a portion of the internal channel, and is held in contact with the first member by cooperating surface features of the first and second screed members; and installing a three part connector disposed within the channel screed, wherein the three part connector comprises an end cap, and two side dams.

17. The method of claim 16 wherein the first member includes one or more fins extending outwardly from one or more of the walls, and wherein the one or more fins are disposed within the building material to form a mechanical connection therewith.

18. The method of claim 16 wherein the second member includes an inner channel formed by a base and opposed walls, and wherein the second member inner channel is disposed within the first member inner channel.

* * * * *